United States Patent [19]

Honsa et al.

[11] Patent Number: 5,031,323

[45] Date of Patent: Jul. 16, 1991

[54] GRIP FOR HAND-HELD POWER TOOLS

[75] Inventors: Thomas W. Honsa, Moline, Ill.; Clifford J. Lafrenz, Donahue, Iowa; Thomas S. Honsa, Moline, Ill.; Delbert M. Stutenberg, Le Claire; Perry W. Woods, Eldridge, both of Iowa

[73] Assignee: CCH Partnership, Moline, Ill.

[21] Appl. No.: 274,880

[22] Filed: Nov. 22, 1988

[51] Int. Cl.[5] ..... B26B 7/00

[52] U.S. Cl. ..... 30/276; 30/298

[58] Field of Search ..... 30/298, 276, 296 R, 30/383, 166, R, 123, 231, 232

[56] References Cited

U.S. PATENT DOCUMENTS 907,345 12/1908 Halfmann ..... 30/298

4,619,047 10/1986 Heckman ..... 30/276

4,694,578 9/1987 Kemmler ..... 30/383

*Primary Examiner*—Douglas D. Watts

*Attorney, Agent, or Firm*—Henderson & Sturm

[57] ABSTRACT

The improved grip is furnished as an adjunct to a tool of the type featuring a horizontal part; e.g., a handle, which carries, for example, a working member such as a rotary slicer operating in a plane parallel to the plane that includes the axis of the handle. The grip is mounted in a position in which it extends upwardly in upright fashion from the aforesaid plane and is mounted on the tool by means including vibration-damping material, which, in conjunction with the upright posture of the grip, minimizes physical tensions in the hand and wrist-/forearm of the user. The attachment also includes a rest for the user's wrist/forearm.

20 Claims, 2 Drawing Sheets

26
24
46
50
50
30
36
28
54
34
48
40
48
42
44
38
16
20
22
12
14
18
10

Fig. 2
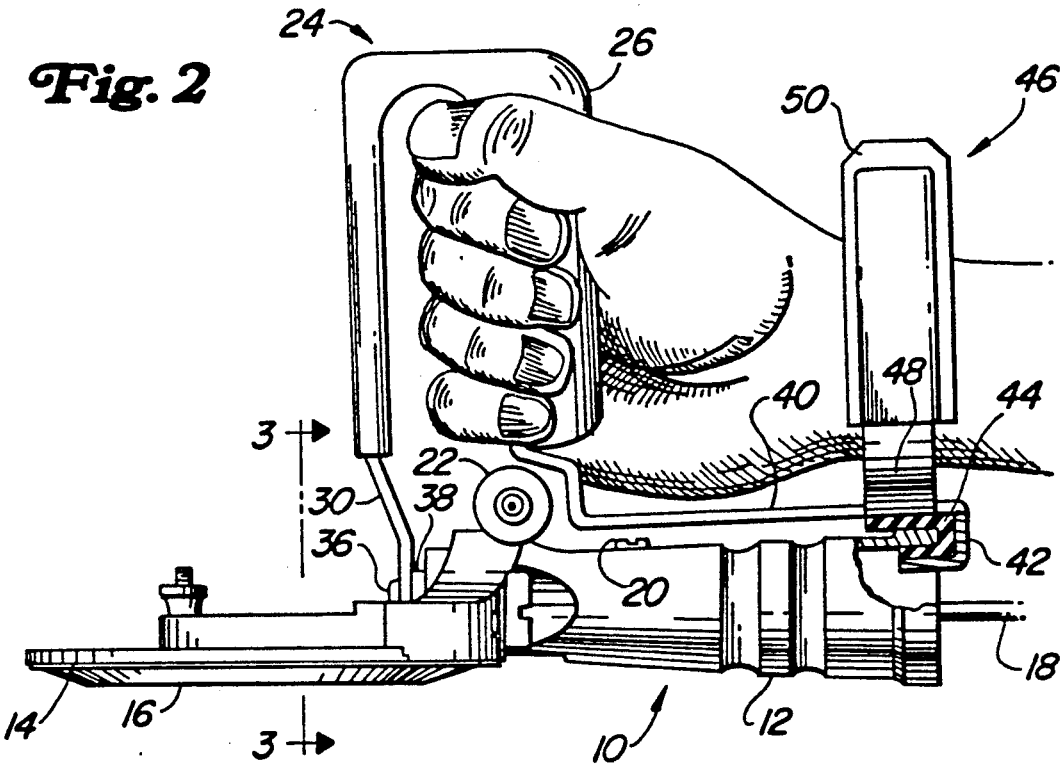
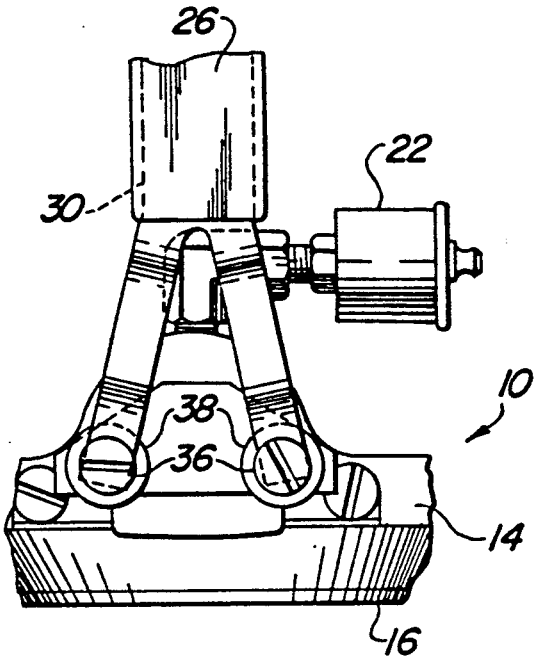
Fig. 3

GRIP FOR HAND-HELD POWER TOOLS

BACKGROUND AND SUMMARY OF THE INVENTION

The invention structure is intended primarily for use with or an improvement in meat slicers of the general character forming the subject matter of the U.S. Pat. No. 4,439,924, to Bettcher for example, wherein the slicer tool comprises a circular frame holding a rotary circular slicer blade and wherein a frame-connected part or handle is disposed generally horizontally as a forward extension of the user's arm. The user grasps the handle from above, for example, and moves the tool over the material to be sliced, typically for removing excess fat from a meat product. During operation of the tool, vibrational and related forces generated by the rotary slicer are transmitted to the handle, because the handle and slicer-supporting frame are rigidly joined together. In addition to user discomfort resulting from the transmission of such forces, the design of the handle requires grasping of the tool in such fashion that the user's hand and forearm become easily fatigued because of the tensions built up during prolonged use of the tool.

According to the present invention, the slicer is modified by the provision of a grip attached to the existing handle or designed as part of an improved slicer in such fashion as to extend upwardly from and generally normal to the handle or its equivalent and configured so that the user can grasp the grip with his fingers wrapped around the grip in generally horizontal mode with his thumb upper most, resulting in a more natural disposition of his hand as respects his wrist and forearm. Additionally, the grip includes a rearward "saddle" extension for receiving the user's wrist/forearm in a comfortable position. Further, the means for mounting the grip on the handle or equivalent part includes the use of vibration-damping material for eliminating or at least minimizing the transmission of operational forces to the user's hand and wrist/forearm. Additionlly, the grip as an attachment is designed to utilize the existing passage by means of which lubricant can be supplied to the drive means for the tool.

The foregoing and other significant features and advantages of the invention will appear as preferred embodiment of the invention is disclosed in the ensuing description and accompanying drawings.

DESCRIPTION OF THE DRAWINGS

FIG. 2 is a side view, showing the slicer in elevation and the grip attachment in section.

FIG. 3 is a fragmentary end view as seen along the line 3—3 of FIG. 2.

DETAILED DESCRIPTION OF A PREFERRED EMBODIMENT OF THE INVENTION

Figure 1:
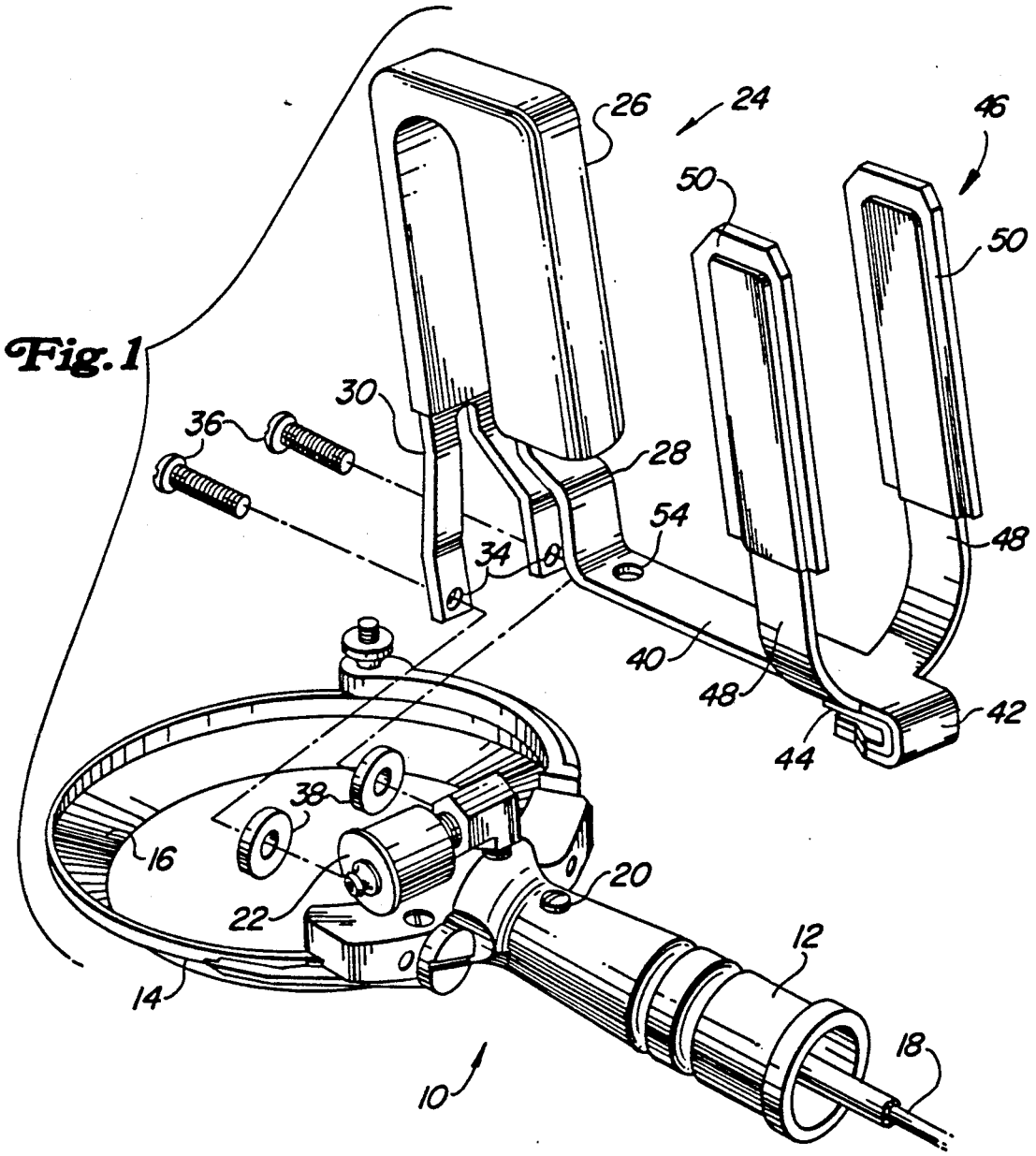
FIG. 1 is an "exploded" perspective of a typical slicer and related components of the inventive attachment.

Reference will be had first to the representative type of tool for which the inventive improvement is especially designed. The present description of that tool will assume familiarity with the details of the Bettcher tool.

The tool is designated in its entirety by the numeral (10) and includes an elongated hollow metallic part such as a handle (12) of circular section, the initial position of which will be assumed to be horizontal and the drawings are so executed, and reference here as well as in the appended claims will be to the horizontal; although, obviously, in use, the tool, and its part (12) will, of course, asseume various positions. So considered, the part (12) is integrally extended forwardly as a circular metaillic frame (14) which, again initially, lies generally in a horizontal plane. This frame peripherally supports a circular blade of knife (16) conventionally driven by means including bevel gearing (not shown) housed in the tool approximately at the junction of the parts (12) and (14). The bevel gearing is driven by drive means including, for example, a flexible shaft (18) which extends axially through the part (12) and is retained by a set screw (20). The driving means of the tool is lubricated via a lube cup (22) in the handle or part (12). As already explained, the tool is used by the operator's grasping the handle from above and wrapping his fingers around the handle whereby the tool becomes essentially an extension of the user's hand and arm.

The attachment design according to the present invention is designated as a whole by the numeral (24) and comprises a hand grip (26) and auxiliary components to be presently described. The grip (26) is here in the form of a metal strap or the like configured as shown to provide a hand-receiving part (28) related as a leg in U-shaped fashion to a forwardly spaced leg (30) which affords a finger guard for the user's fingers, which, as seen in FIG. 2, grasp the part or leg (28) from the rear and wrap generally horizontally about that leg and are protected from the knife or slicer blade by the front leg or guard (30). The entire grip, including the legs (28) and (30) and top of the U are covered by elastomer or equivalent shock-absorbing material (32) that is operative to reduce the transmission of tool-generated forces to the user's hand.

Mounting means for securing the grip to the frame comprise, in part, a lower extension of the finger guard as a bifurcation that affords a pair of laterally spaced eyes (34) that receive screw means (36) receivable in tapped bores (not shown) typically present in tools of the aforesaid patented type. The screws (36) here are somewhat longer than the original screws to accommodate the thickness of the material forming the eyes (34). Elastomer or equivalent washers (38) are interposed in the screw-eye mounts for shock-reducing purposes, combining with the material (32) and further means to be described later in materially reducing the transmission of shocks from the tool to the user and thereby minimizing operator fatigue, stress and other factors that contribute to carpal tunnel syndrome.

The grip is here shown as being of one-piece construction in which the lower end portion of the rear leg or finger-receiving part (28) is bent horizontally rearwardly as a spine (40) that lies in spaced relation along and above the handle or part (12) and contributes to the mounting means by having its rear end provided with an integral hook (42) which hooks forwardly into the rear end of the tubular hander part (12), being vibration-damped therefrom by appropriate vibration-absorbing material (44).

The spine (40) serves a further purpose inasmuch as its configuration is such as to afford a saddle (46) spaced rearwardly of the grip members (28) and (30) and having spaced upright arms (48), elastomer or equivalent covered at (50) for receiving the user's wrist/forearm and thus giving him better and more comfortable control of the tool.

In the adaptation of the invention as an attachment to existing tools provision is made for relocating the usual lube fitting, conventionally upright. In the present form of the invention, an "L" fitting (52) is threaded into the existing lube passage and receives existing lube cup, already noted at (22). As best seen in FIG. 1, the spine has an opening (54) which registers with the screw (20) to provide access to the screw if needed. Other than the minor changes just noted, the existing tool remains functionally operative, i.e., no basic structural changes are made to accommodate the attachment; still, the operation of the tool is made easier, more efficient and less tiring.

On the basis of the foregoing, it will be readily seen that the inventive concepts can be easily applied as part of a tool constructed to include the upright grip and its adjuncts. In any event, however, the invention is exploited, it serves significantly as a tool improvement that eliminates much if not all of the major causes of operator discomfort and physiological trauma. Features and advantages not specifically pointed out herein will readily occur to those versed in the art, as will many modifications and adaptations of the preferred embodiment disclosed, all without departure from the spirit scope of the invention.

I claim:

1. For use with a hand-held rotary tool having a horizontal circular frame of rigid construction and including a tubular, horizontal, rigid handle rigidly joined to and projecting from the frame to be grasped from above by a user's hand with the user's fingers generally vertically and a circular rotary cutter carried by the frame, an attachment comprising an upright grip having upper and lower portions, and means mounting the grip on the handle as a replacement for the handle and intended to be operatively grasped by a user's hand with the user's fingers disposed generally horizontally.

2. The attachment according to claim 1, in which the mounting means includes vibration-absorbing material between the grip and the handle.

3. The attachment according to claim 1, in which the grip is enclosed in vibration-absorbing material.

4. The attachment according to claim 1, in which the grip includes a portion extending closely above and along the handle and away from the frame and having a saddle for receiving the user's wrist/forearm.

5. The attachment according to claim 4, in which said portion comprises part of the mounting means.

6. the attachment according to claim 5, in which said part of the mounting means includes a hook engaging and extending forwardly into a rear part of the tubular handle.

7. The attachment according to claim 6, including vibration-absorbing material interposed between the hook and the handle.

8. The attachment according to claim 1, in which the grip includes a hand-receiving part and a finger guard attached to and spaced ahead of the hand-receiving part.

9. The attachment according to claim 8, in which the finger guard is extended downwardly and comprises part of the mounting means.

10. The attachment according to claim 1, in which the grip includes an element of invention U-shaped configuration having upright front and rear legs, the rear leg serving to be grasped by the user's fingers and the front leg serving a finger guard.

11. The attachment according to claim 10, in which the front leg serves as part of the mounting means.

12. The attachment according to claim 11, in which the front leg has a lower bifurcated portion providing laterally spaced apart eyes and screw means are passed respectively through the eyes and into the frame.

13. The attachment according to claim 12, including vibration-absorbing material inteposed between the eyes and the screw means.

14. The attachment according to claim 10, in which the front leg has a lower extension providing part of the mounting means, the rear leg has an integral lower portion extended rearwardly in spaced relation above the handle and having a terminal rear end providing another part of the mounting means.

15. The attachment according to claim 14, in which the rearwardly extended portion of the rear leg has a saddle for receiving the user's wrist/forearm.

16. A rotary, hand-held slicing tool, comprising a horizontal circular frame, a horizontal circular cutter rotatably carried by the frame, and an upright grip carried by and projecting upwardly from the frame in a position rearwardly clear of the cutter and intended to be operatively grasped from the rear by a user's hand with the user's fingers disposed generally horizontally about the grip.

17. A slicing tool according to claim 16, including a finger guard spaced ahead of the grip.

18. A slicing tool according to claim 16, including a rearward extension on the lower part of the grip including a saddle for receiving the user's wrist forearm.

19. A slicing tool according to claim 18, including mounting means connecting the saddle to the frame in rearwardly spaced relation to the grip and including vibration-absorbing means operative to reduce the transmission of tool-generated forces to the saddle.

20. A slicing tool according to claim 16, in which the grip is carried by the frame by means including vibration-absorbing material operative to reduce the transmission of tool-generated forces to the grip.

* * * * *

UNITED STATES PATENT AND TRADEMARK OFFICE

CERTIFICATE OF CORRECTION

PATENT NO. : 5,031,323

DATED : July 16, 1991

INVENTOR(S) : Thomas W. Honsa, Clifford J. Lafrenz, Thomas S. Honsa, Delbert M. Stutenberg and Perry W. Woods It is certified that error appears in the above-identified patent and that said Letters Patent is hereby corrected as shown below:

At Column 2, line 2 "asseume" should read --assume--. At Column 2, line 4 "metaillic" should read --metallic--. At Column 2, line 6 "of" should read --cr--. At Column 2, line 57 "hander" should read --handle--. At Column 3, line 23 --and-- was eliminated between "spirit" and "scope." At Column 4, line 20 "inteposed" should read --interposed--. At Column 4, line 43 "wrist forearm" should read --wrist/forearm--.

At Column 4, line 51 "material" should read --materially--.

Signed and Sealed this

Tenth Day of November, 1992

*Attest:*

DOUGLAS B. COMER

*Attesting Officer*

*Acting Commissioner of Patents and Trademarks*